US005417811A

United States Patent [19]

Malsbury

[11] Patent Number: 5,417,811

[45] Date of Patent: May 23, 1995

[54] CLOSURE DEVICE FOR UPPER HEAD OF COKING DRUMS

[75] Inventor: Allen S. Malsbury, Parsippany, N.J.

[73] Assignee: Foster Wheeler USA Corporation, Clinton, N.J.

[21] Appl. No.: 259,102

[22] Filed: Jun. 13, 1994

[51] Int. Cl.[6] ..... C10B 1/04

[52] U.S. Cl. ..... 202/241; 196/122; 196/137; 202/250; 202/269

[58] Field of Search ..... 201/2, 41; 196/122, 196/137; 202/241, 250, 269

[56] References Cited

U.S. PATENT DOCUMENTS

| | | | |
|---|---|---|---|
| 380,910 | 4/1888 | McGee | 202/241 |
| 2,326,525 | 8/1943 | Diwoky | 196/122 |
| 3,143,302 | 8/1964 | Carlson et al. | 196/122 |
| 5,259,930 | 11/1993 | Barker et al. | 201/2 |

*Primary Examiner*—Joye L. Woodard
*Attorney, Agent, or Firm*—Marvin A. Naigur

[57] ABSTRACT

A closure device adapted for attachment onto the upper head of a coking drum to prevent hot vapors escaping during drum decoking operations. The closure device includes a cylindrical-shaped housing having a rotatable ball valve and horizontal elongated stem provided in its lower portion, and a cover unit including a packing gland provided at the housing upper end. A rotatable cutting tool provided within the housing above the ball valve has a drive rod extending upwardly through the cover unit packing gland. During operations, the ball valve is opened and the drive rod and its attached cutting tool can be extended downwardly through the ball valve cylindrical-shaped opening into the coking drum and rotated, so as to cut and dislodge coke deposited in the drum.

12 Claims, 3 Drawing Sheets

CLOSURE DEVICE FOR UPPER HEAD OF COKING DRUMS

BACKGROUND OF INVENTION

This invention pertains to an upper head closure device for coking drums. It pertains particularly to such a closure device including a housing containing a rotatable ball valve and having a cover unit and rotatable cutting tool, all for attachment onto a coking drum upper head so as to permit convenient and safe coke drilling and removal from the drum.

Coking drums, from which coke deposited therein from coal or heavy hydrocarbon feedstocks must be removed periodically, usually require removal of an upper head flanged cover for insertion of tools for drilling or cutting the coke prior to its removal. However, this flange cover removal operation is somewhat hazardous to personnel because of escaping hot vapors and liquids from the drum. Currently, coking drums have a bolted blind flange cover that is manually removed for insertion of the coke drilling tools into the drum. During such operation, personnel removing the top flange cover are exposed to escaping hot vapors which may contain solids and/or liquids and is a serious problem. The present invention provides a closure device which obviates such hazardous removal of the upper flange cover during operation of coking drums.

Although the prior art has provided some valve type closure devices useful for gas supply systems from coking drums, none of these valve configurations are suitable for solving the present problem. For example, U.S. Pat. No. 4,797 to Chapman discloses a quick-opening manually-operated valve arrangement adapted for attachment onto gas supply systems. U.S. Pat. No. 1,517,786 to Kus discloses a curved gate valve for periodic closure of ascension pipes of a coking gas supply system. U.S. Pat. No. 1,580,323 to Paul discloses a valve configuration used on the upper end of a steam evaporator. U.S. Pat. No. 2,082,118 to Potter discloses a gas take-off valve configuration useful for withdrawing gas from coking drums. U.S. Pat. No. 2,603,232 to Keammerer discloses a rotary valve for coking gas supply systems, the valve utilizing a liquid seal and curved sealing surface. U.S. Pat. No. 3,858,609 to Stanke et al discloses a pivoted valve flap closure for use with the ascension pipe of a coke oven, which valve is operated by an external actuator. Also, U.S. Pat. No. 4,382,841 to Koddenberg discloses a coke gas conduit supply system which utilizes dual pivoted flapper valves operated in sequence. However, none of these known shut-off valve configurations for coking drums incorporate a rotary cutting or drilling tool which can be periodically extended downwardly through an open valve into a coking drum for loosening coke deposited in the drum, and thereby avoids periodic hazardous removal of an upper head flanged cover on the drum.

SUMMARY OF INVENTION

This invention provides a closure device adapted for attachment pressure-tightly onto the upper head flange of a coking drum, which device avoids the usual periodic removal of a conventional flange cover and consequently exposing personnel to escaping hot vapors and entrained solids and/or liquids contained in the drum. The closure device includes an elongated cylindrical-shaped housing having upper and lower end flanges, and a rotatable ball type valve provided within the housing lower portion. The ball valve rotor has a cylindrical-shaped opening and includes an elongated stem which extends through a pressure-tight packing gland rigidly attached onto a side wall of the housing. The closure device has an upper cover unit including a packing gland and guide for a rotatable cutting tool having a drive rod extending through the packing gland. The cutting tool rotatable drive rod is attached to a cutting blade provided within the housing above the ball valve, so that the tool blade fits between the closed ball valve and the pressure-containing packing gland and guide for the drive rod. With the cutting tool in place above the closed ball valve, the ball valve can be opened and the rotatable cutting tool blade and its drive rod can be advanced downwardly through the valve rotor and into the coking drum for cutting and loosening coke deposited therein.

This invention advantageously provides a reliable and safe means for periodically drilling and loosening coke deposited in a coking drum, and eliminates the need for removal of the conventional flange cover from a coking drum top head and the associated risks to operating personnel caused by escaping hot vapors from the coking drum.

BRIEF DESCRIPTION OF DRAWINGS

This invention will be further described with reference to the following drawings, in which.

DESCRIPTION OF INVENTION

Figure 1:
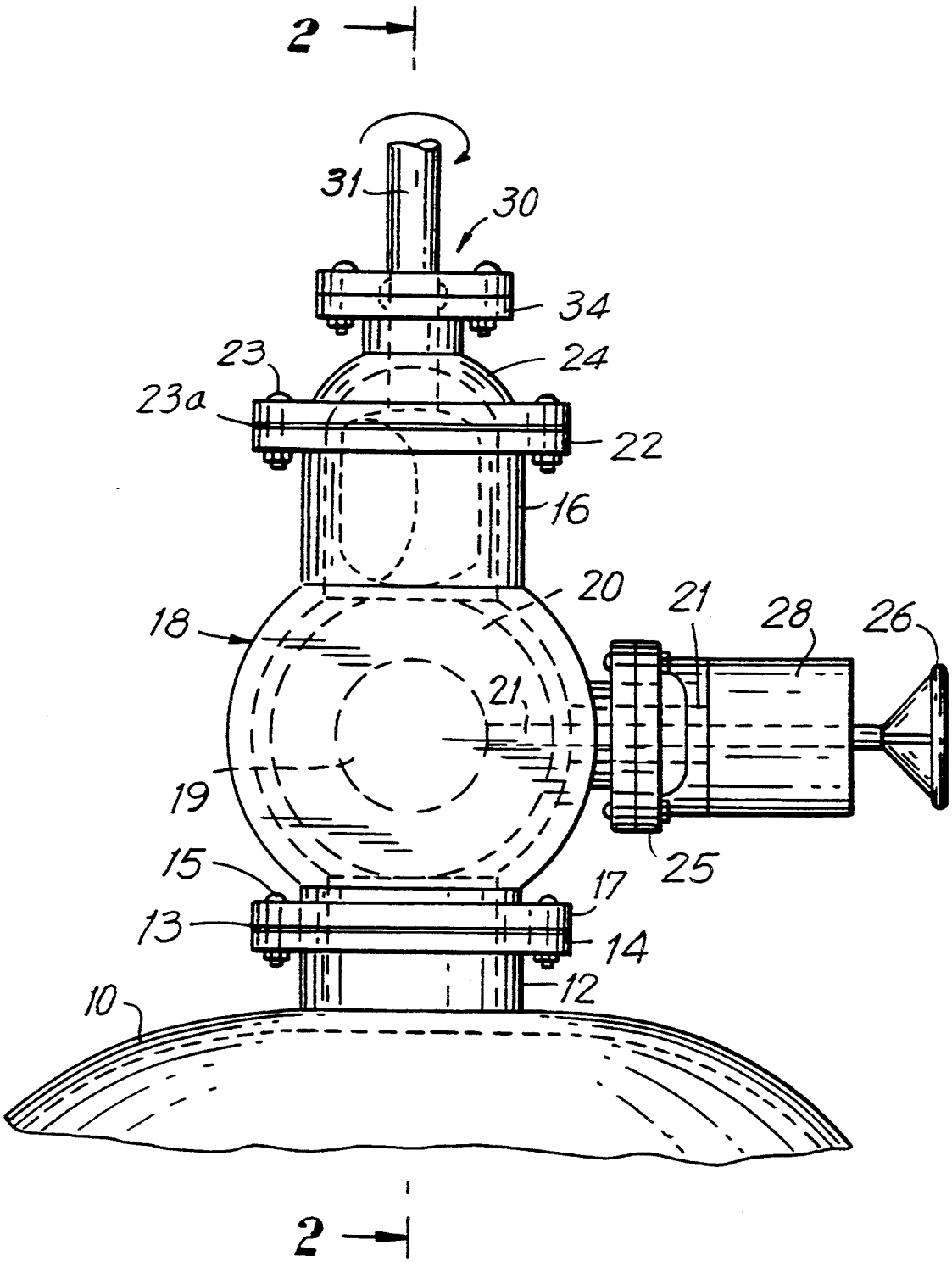
FIG. 1 shows an elevation view of a closure device according to the invention attached onto the upper head of a coking drum, the closure device containing a rotatable ball valve and cutting tool to facilitate coke removal from the drum.

As shown by FIG. 1, a vertically oriented coking drum 10 includes an upper nozzle connection 12 and attached flange 14. A closure device includes a cylindrical-shaped housing 16 which is removably attached pressure-tightly onto the flange 14, such as with a suitable gasket 13 and a plurality of bolts 15. The housing 16 includes a lower portion which has a lower flange 17 and contains a ball type valve 18 having a spherical-shaped rotor 20, the housing has an upper portion extending above the valve rotor to an upper flange 22. A cover unit 24 is removably attached pressure-tightly onto the housing upper flange 22 such as by a plurality of bolts 23 and suitable gasket 23*a*.

The ball valve rotor 20 has a cylindrical-shaped through opening 19 and an elongated stem 21 which is rigidly attached onto the ball valve rotor at 90° angle to the centerline of opening 19. The stem 21 extends outwardly through a pressure-tight packing gland 25, and may be removably attached at its outer end to an operating handle 26. The handle 26 can be operated so as to rotate the stem 21 and ball valve 20 through a 90° angle from a closed position and return to an open position. However, the ball valve rotor 20 is preferably rotatably operated by a reversible mechanical actuator 28, which can be either a hydraulic pressure or electric motor operated type.

The housing 16 cylindrical-shaped upper portion which has smaller inner diameter than the lower portion of the housing 16 and contains a rotatable cutting tool 30, which tool includes an elongated drive rod 31 attached to a tool blade 32. The tool drive rod 31 extends upwardly through guide and packing gland 34 provided in the cover unit 24. Various shape cutting tools 30 can be selected for effective drilling of coke. The cutting tool 30 with blade 32 is rotatable within housing 16 by suitable drive means such as an electric motor and gear unit (not shown) connected to the drive rod 31. With the rotary cutting tool 30 located in place within housing 16 above the ball valve rotor 20, the ball valve can be opened so that the cutting tool 30 can be extended downwardly through cylindrical opening 19 in the valve ball rotor 20, and into the coking drum 10. Rotating the cutting tool 30 cuts the coke deposited in the drum and permits coke removal from the lower end of the coking drum 10 through a bottom opening (not shown).

The closure device must be suitable for operation at temperatures of 600°–1000° F. and pressures of 100–500 psig. The housing 16 material and the ball valve 18 are made of alloy steel, with the ball outer surface being hardened to prevent undesired abrasion caused by coke particulates and such.

Figure 2:
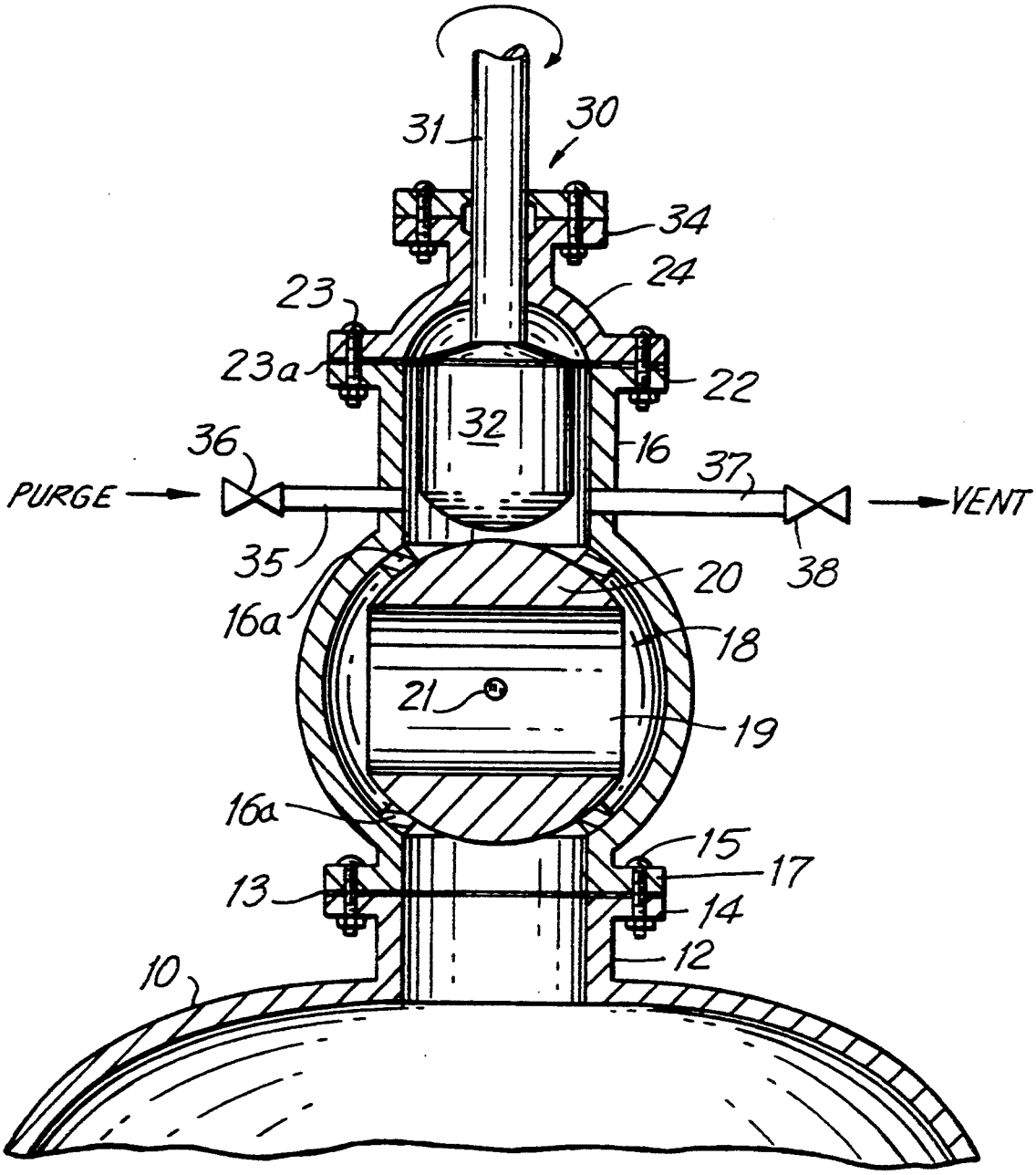
FIG. 2 shows an elevational sectional view of the closure device taken along line 2—2 of FIG. 1 with the rotatable ball valve being shown in its closed position, and the cutting tool positioned above the ball valve.

The closure device according to this invention is additionally shown by the FIG. 2 sectional view, in which the ball valve 18 is in a closed position and the cutting tool 30 is located above the closed valve. One or more resilient seal elements **16*a* can be provided within housing 16 so that they fit closely against the outer spherical shaped surface of the ball valve rotor 20, and thereby provide an effective seal to prevent escape of hot vapors past the closed valve. Thus whenever the cover unit 24 and cutting tool 30 are removed from housing 16 such as for maintenance purposes, hot vapors cannot escape from the coking drum 10. The seal elements 16*a* should be formed of a material suitable for withstanding temperatures of 500°–850° F. A gas purge conduit 35 having shut-off valve 36 is preferably provided for introducing an inert purge gas such as low pressure steam into the housing 16 prior to any removal of cover unit 24, which gas is withdrawn at vent connection 37 having shut-off valve 38**.

Figure 3:
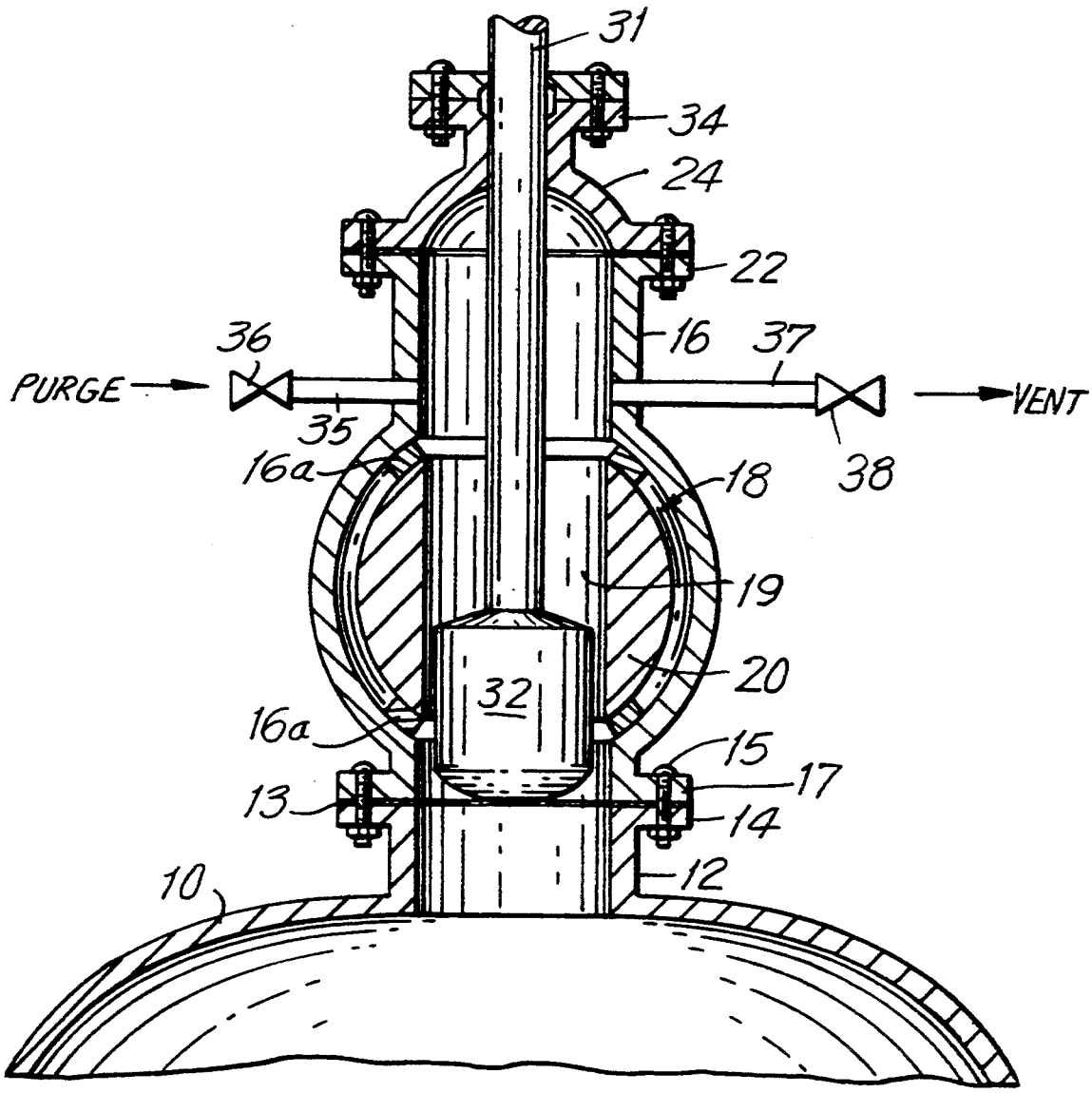
FIG. 3 is a sectional view similar to FIG. 2 except showing the closure device with the ball-valve rotated to its open position, and with the rotatable cutting tool partially advanced downwardly through the open valve into the coking drum.

The closure device of this invention is further shown by sectional drawing FIG. 3, which is similar to FIG. 2 except the ball valve rotor 20 is in its open position and cutting tool 30 is extended downwardly through the valve cylindrical opening 19. The rotatable cutting tool 30 can be extended further downwardly into the coking drum 10 for drilling into and loosening coke deposited therein, so as to permit coke removal through a bottom opening in the drum 10. This closure device of this invention will be further described by the following Example, which should not be construed as limiting the scope of the invention.

EXAMPLE

A closure device is provided which is adapted for attachment onto the upper head flange of a vertically oriented coking drum. The closure device includes a cylindrical-shaped housing which contains a rotatable ball valve in its lower portion and an upper cover unit including a packing gland. The ball valve has an elongated stem which extends horizontally through a packing gland and is attached at its outer end to a suitable actuator adapted to rotate the valve through a 90° angle from a closed position to an open position and return. A rotatable drilling tool is provided in the housing upper portion, and has an elongated drive rod extending upwardly through the packing gland. The drive rod and attached cutting tool can be moved downwardly through the open ball valve so as to drill into coke deposited in the coking drum and facilitate coke removal from the drum lower end. Important characteristics of the closure device and coking drum are as follows:

| | |
|---|---|
| Housing length, ft. | 6 |
| Ball valve outer diameter, inch | 36 |
| Ball valve opening diameter, inch | 24 |
| Cutting blade diameter, inch | 18 |
| Cutting blade length, inch | 18 |
| Drive rod diameter, inch | 6 |
| Coking drum flange diameter, ft. | 2 |
| Coking drum diameter, ft. | 12 |
| Coking drum length, ft. | 50 |

When it is desired to periodically drill into and remove the coke deposited in the coking drum, the ball valve is opened and the drilling blade is inserted downwardly through the valve opening and rotated at sufficient speed to cut into the coke so that it can be removed from the coking drum.

Although this invention has been described broadly and in terms of preferred embodiments, it will be understood that modifications and variations to the closure device can be made within the spirit and scope of the invention, which is defined by the following claims.

I claim:

1. A closure device for rigid attachment onto an upper head of a coking drum, said device comprising:

(a) an elongated cylindrical-shaped housing having an upper end and a lower end with a flange provided at the housing lower end for attachment pressure-tightly onto a coking drum upper head flange, said housing including a flange provided at the housing upper end;

(b) a rotary ball valve provided within a lower portion of said housing, said ball valve including an spherical-shaped rotor and having a cylindrical-shaped opening extending through the valve rotor and including an elongated stem rigidly attached onto the valve rotor at a 90° angle to the rotor opening and extending pressure-tightly through a side wall of said housing;

(c) a flanged cover unit attached onto said housing upper end flange, said cover unit including a packing gland; and (d) a rotatable cutting tool including an elongated drive rod extending through said packing gland, said cutting tool being sized for passage downwardly through the opening in said ball valve rotor and into a coking drum for drilling and dislodging coke deposits in the coking drum.

2. The closure device of claim 1, wherein said housing includes an upper cylindrical-shaped portion which has an inner diameter smaller than that of the housing lower portion.

3. The closure device of claim 1, wherein at least one seal means is provided within the housing lower portion, and said spherical-shaped valve rotor is fitted closely within the at least one seal means.

4. The closure device of claim 3, wherein said seal means is a ring formed of a material suitable for operation at 500°–850° F. temperature.

5. The closure device of claim 1 wherein said ball valve includes mechanical actuator means attached to said elongated stem at its outer end for rotating said ball valve through a 90° angle from a closed to an open position and return.

6. The closure device of claim 5, wherein said actuator means is an electric motor type actuator.

7. The closure device of claim 1, wherein said housing and ball valve are made of alloy steel and are suitable for operation at 600°–1000° F. temperature and 100–500 psig pressure.

8. The closure device of claim 1, wherein said cutting tool has a blade shaped so as to effectively cut and loosen coke deposits in a coking drum.

9. The closure device of claim 1, wherein said housing includes a gas purge connection and a vent connection located above said ball valve, each said connection having a shut-off valve.

10. The closure device of claim 1, wherein said ball valve rotor has spherical-shaped outer surface which is hardened to prevent abrasion by coke particles.

11. The closure device of claim 1 in combination with a coking drum having an upper flange, wherein said housing lower flange is attached pressure-tightly onto the upper flange of the coking drum.

12. A closure device for rigid attachment onto an upper head of a coking drum, said device comprising:

(a) an elongated cylindrical-shaped housing having an upper end and a lower end, with a flange provided at the housing lower end for attachment pressure-tightly onto a coking drum upper head flange, said housing including a flange provided at the housing upper end;

(b) a rotary ball valve provided within a lower portion of said housing, said ball valve including a spherical-shaped rotor fitting closely within a resilient seal provided in said housing, and having a cylindrical-shaped opening extending through the valve rotor, said valve rotor having an elongated stem rigidly attached onto the valve rotor at a 90° angle to said rotor opening and extending through a side wall of said housing, said stem being connected at its outer end to an actuator means for rotating the ball valve rotor through a 90° angle from a closed position to an open position;

(c) a flanged cover unit attached pressure-tightly onto said housing upper end flange, said cover unit including a packing gland;

(d) a gas purge connection and a vent connection attached to the housing above the ball valve; and (e) a rotatable cutting tool including an elongated drive rod extending through said packing gland and having a cutting blade attached to the drive rod, said cutting tool being sized for passage downwardly through the opening in said ball valve rotor and into a coking drum for cutting and dislodging coke deposits in the coking drum.

* * * * *